US005871895A

United States Patent [19]

Sato

[11] Patent Number: 5,871,895

[45] Date of Patent: Feb. 16, 1999

[54] SILVER HALIDE COLOR PHOTOGRAPHIC MATERIAL

[75] Inventor: Kozo Sato, Kanagawa, Japan

[73] Assignee: Fuji Photo Film Co., Ltd., Minami-ashigara, Japan

[21] Appl. No.: 822,686

[22] Filed: Mar. 24, 1997

[30] Foreign Application Priority Data

Mar. 25, 1996 [JP] Japan ..... 8-068068

[51] Int. Cl.[6] ..... G03C 1/08; G03C 7/26; G03C 7/32

[52] U.S. Cl. ..... 430/558; 430/543

[58] Field of Search ..... 430/543, 558

[56] References Cited

U.S. PATENT DOCUMENTS

| | | | |
|---|---|---|---|
| 4,873,183 | 10/1989 | Tachibana et al. | 430/550 |
| 5,270,153 | 12/1993 | Suzuki et al. | 430/558 |
| 5,370,978 | 12/1994 | Takahashi | 430/558 |
| 5,639,590 | 6/1997 | Yoshioka | 430/558 |

FOREIGN PATENT DOCUMENTS

249453A2 12/1987 European Pat. Off. .

491197A1 6/1992 European Pat. Off. .

*Primary Examiner*—Geraldine Letscher

*Attorney, Agent, or Firm*—Burns, Doane, Swecker & Mathis, LLP

[57] ABSTRACT

A silver halide color photographic material is disclosed which contains at least one 1H-pyrrolo[1,2-c][1,2,3]triazole based dye-forming coupler represented by the following formula:

wherein $R_1$, $R_2$ and $R_3$ each represents a hydrogen atom or a substituent; and X represents a hydrogen atom or a group capable of being released upon reaction with the oxidation product of a color developing agent.

3 Claims, No Drawings

SILVER HALIDE COLOR PHOTOGRAPHIC MATERIAL

FIELD OF THE INVENTION

The present invention relates to a silver halide color photographic material which contains a novel dye-forming coupler.

BACKGROUND OF THE INVENTION

A color image is formed by three primary colors of yellow, magenta and cyan in a silver halide color photographic material according to a subtractive color process. Phenol-based couplers and naphthol-based couplers have been used for a long time as a cyan coupler. However, the dyes formed by these couplers have undesired side absorption or have unnecessary absorption since absorption spectrum thereof is broad, accordingly, the improvement has been desired from color reproduction. Further, they have such problems as the molecular extinction coefficient of the dyes obtained is small, therefore, large quantities of couplers and silver halide are necessary to obtain a desired color density, as a result, the film thickness of a photographic material becomes thick and the sharpness of the color image obtained is lowered.

In recent years, pyrazoloazoles disclosed in U.S. Pat. No. 4,873,183, diphenylimidazoles disclosed in EP-A-249453 and pyrroloazoles disclosed in EP-A-491197 are proposed as a cyan coupler to provide dyes which have big molecular extinction coefficients, excellent absorption properties in a visible region and are improved in color reproducibility. However, any dyes derived from the above couplers have serious drawbacks such that they are inferior in light fastness and color images are discolored by exposure to light of a comparatively short period of time.

SUMMARY OF THE INVENTION

An object of the present invention is to provide a dye-forming coupler which can provide a dye having an excellent hue and good light fastness.

Another object of the present invention is to provide a silver halide color photographic material containing such a coupler and showing excellent color reproducibility and color images of good light fastness.

The present inventor eagerly investigated a coupler having a novel skeleton and found that the above objects of the present invention have been achieved by the dye-forming coupler represented by the following formula and a silver halide color photographic material containing at least one of the above dye-forming couplers:

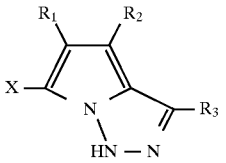

wherein $R_1$, $R_2$ and $R_3$ each represents a hydrogen atom or a substituent; and X represents a hydrogen atom or a group capable of being released upon reaction with the oxidation product of a color developing agent, and $R_1$ and $R_2$, or $R_2$ and $R_3$ may be connected to each other to form a 5- or 6-membered ring.

DETAILED DESCRIPTION OF THE INVENTION

A dye-forming coupler according to the present invention will be described in detail below.

In the above formula, $R_1$, $R_2$ and $R_3$ each represents a hydrogen atom or a substituent; and X represents a hydrogen atom or a group capable of being released upon reaction with the oxidation product of a color developing agent. $R_1$, $R_2$ and $R_3$ each represents a hydrogen atom, a halogen atom (e.g., fluorine, chlorine, bromine), a substituted or unsubstituted alkyl group (e.g., ethyl, butyl, octyl, 2-ethylhexyl, dodecyl, hexadecyl, t-butyl, t-octyl, isopropyl, isobutyl, isodecyl, isostearyl, dodecyloxypropyl, 3-(2,4-di-t-amylphenoxy)propyl, trifluoromethyl, benzyl, 2-phenethyl, α-methylbenzyl, methanesulfonylaminoethyl), a cycloalkyl group (e.g., cyclohexyl, 4-t-butylcyclohexyl), a substituted or unsubstituted aryl group (e.g., phenyl, p-tolyl, p-anisyl, p-chlorophenyl, 4-t-butylphenyl, 2,4-di-t-amylphenyl), a heterocyclic group (e.g., 2-furyl, 2-thienyl, 2-benzothiazolyl), a cyano group, a hydroxyl group, a nitro group, a carboxyl group, a substituted or unsubstituted amino group (e.g., amino, methylamino, dimethylamino, anilino, N-methylanilino), an alkoxyl group (e.g., methoxy, butoxy, methoxyethoxy, dodecyloxy, 2-ethylhexyloxy), an aryloxy group (e.g., phenoxy, p-tolyloxy, p-chlorophenoxy, 4-t-butylphenoxy), an acylamino group (e.g., acetamido, benzamido, tetradecanamido, 2-(2,4-di-t-amylphenoxy) butanamido, 4-(3-t-butyl-4-hydroxyphenoxy)butanamido), a substituted ureido group (e.g., 3-methylureido, 3-phenylureido, 3,3-dibutylureido), a substituted or unsubstituted carbamoyl group (e.g., ethylcarbamoyl, dibutylcarbamoyl, dodecyloxypropylcarbamoyl, 3-(2,4-di-t-amylphenoxy)propylcarbamoyl, piperidinocarbonyl, morpholinocarbonyl), an alkoxycarbonylamino group (e.g., ethoxycarbonylamino, dodecyloxycarbonylamino), an alkylthio group (e.g., butylthio, dodecylthio, hexadecylthio, 3-phenoxypropylthio), an arylthio group (e.g., phenylthio, 4-t-butylphenylthio, 2-butoxy-5-t-octylphenylthio, 4-tetradecanamidophenylthio), a sulfonamido group (e.g., methanesulfonamido, butanesulfonamido, hexadecanesulfonamido, benzenesulfonamido, p-toluenesulfonamido, 2-butoxy-5-t-butylbenzenesulfonamido, 2-octyloxy-5-t-octylbenzenesulfonamido), a substituted or unsubstituted sulfamoyl group (e.g., sulfamoyl, ethylsulfamoyl, diethylsulfamoyl, ethyldodecylsulfamoyl, phenylsulfamoyl, 2-chlorophenylsulfamoyl, 3-(2,4-di-t-amylphenoxy) propylsulfamoyl), a sulfonyl group (e.g., methanesulfonyl, benzenesulfonyl, p-toluenesulfonyl, dodecylsulfonyl, 4-t-octylbenzenesulfonyl), an alkoxycarbonyl group (e.g., ethoxycarbonyl, dodecyloxycarbonyl, isotetradecyloxycarbonyl), an aryloxycarbonyl group (e.g., phenoxycarbonyl, p-t-octylphenylcarbonyl), an acyl group (e.g., acetyl, benzoyl, p-toluoyl), an acyloxy group (e.g., acetoxy, dodecanoyloxy, benzoyloxy, p-t-butylbenzoyloxy), an imido group (e.g., phthalimido-1-yl, 1-benzylhydantoin-3-yl, 3-octadecenylsuccinimido-1-yl), a sulfinyl group (e.g., octylsulfinyl, dodecylsulfinyl, 3-pentadecylphenylsulfinyl), a phosphoryl group (e.g., diethylphosphoryl, dioctylphosphoryl, didodecylphosphoryl), or a heterocyclic group (e.g., 2-pyridyl, 4-pyridyl, 2-thienyl, 2-thiazolyl, 2-benzothiazolyl, 1-benzotriazolyl, 5-methyltetrazol-2-yl). Of these substituents, those capable of being substituted may further be substituted with other substituents.

In a preferred dye-forming coupler according to the present invention, $R_1$ represents an electron withdrawing group having a Hammett's $\sigma_p$ value of 0.3 or more. In a particularly preferred dye-forming coupler according to the present invention, both $R_1$ and $R_2$ represent an electron withdrawing group having a Hammett's $\sigma_p$ value of 0.3 or more. In a coupler according to the present invention, when strong electron withdrawing groups are introduced into $R_1$ and $R_2$, the absorption of the dye formed is shifted to longer wavelength, and exhibits preferred absorption properties as a cyan dye upon oxidation coupling with a phenylenediamine based color developing agent and as a magenta or blue dye upon oxidation coupling with a hydrazine based reducing agent for color forming. On the other hand, a coupler in which $R_1$ and $R_2$ are not an electron withdrawing group is useful as a magenta coupler in oxidation coupling with a phenylenediamine based color developing agent, which exhibits preferred absorption properties as a yellow or orange dye upon oxidation coupling with a hydrazine based reducing agent for color forming.

A Hammett's $\sigma_p$ value is disclosed in various general literature, for example, disclosed in detail in *Kagaku no Ryoiki, Zokan,* No. 122, pages 96 to 103, 1979 (Nankodo) and *Chemical Reviews,* Vol. 91, pages 165 to 195, 1991. Any electron withdrawing groups having a Hammett's $\sigma_p$ value of 0.3 or more disclosed in various literature can be preferably used in the present invention, in addition to those disclosed in the above literature. Specific examples of electron withdrawing groups having $\sigma_p$ value of 0.3 or more include a nitro group, a cyano group, an alkylsulfonyl group, an arylsulfonyl group, an acyl group, an alkoxycarbonyl group, an aryloxycarbonyl group, a substituted or unsubstituted carbamoyl group, a substituted or unsubstituted sulfamoyl group, a dialkylphosphoryl group, a dialkylphosphono group, a diarylphosphono group, a dialkylphosphinyl group, a diarylphosphinyl group, an alkylsulfinyl group, an arylsulfinyl group, a perfluoroalkyl group and a pentahaloaryl group.

Preferred examples of $R_1$ and $R_2$ include a cyano group, an alkoxycarbonyl group (e.g., ethoxycarbonyl, isohexadecyloxycarbonyl, 2,6-di-t-butyl-4-methylcyclohexyloxycarbonyl), a perfluoroalkyl group (e.g., trifluoromethyl, heptafluoropropyl), an acyl group (e.g., acetyl, benzoyl), a sulfonyl group (e.g., methanesulfonyl, benzenesulfonyl), a carbamoyl group (e.g., ethylcarbamoyl, phenylcarbamoyl, dodecylcarbamoyl), a sulfamoyl group (e.g., butylsulfamoyl, phenylsulfamoyl, dodecylsulfamoyl), a sulfinyl group (e.g., methylsulfinyl), a phosphoryl group (e.g., diethylphosphoryl), a phosphinyl group (e.g., diethylphosphinyl), and an aryl group (e.g., pentafluorophenyl, 4-nitrophenyl).

Particularly preferred examples of $R_1$ include a cyano group, an alkoxycarbonyl group, an aryl group and a perfluoroalkyl group.

Particularly preferred examples of $R_2$ include a cyano group, an alkoxycarbonyl group, a carbamoyl group, an aryl group and a perfluoroalkyl group.

Preferred examples of $R_3$ include a hydrogen atom, a halogen atom (e.g., chlorine, bromine), an alkyl group (e.g., a straight or branched alkyl, aralkyl, alkenyl, alkinyl, cycloalkyl or cycloalkenyl group having 1 to 32 carbon atoms; more specifically, methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamide}phenyl}propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, 4-tetradecaneamidephenyl), a heterocyclic group (e.g., 2-furyl, 2-thienyl, 2-pyrimidinyl, 2-benzothiazolyl), a cyano group, a nitro group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamido, benzamido, tetradecanamido, 2-(2,4-di-t-amylphenoxy)butanamido, 4-(3-t-butyl-4-hydroxyphenoxy)butanamido), 2-{4-(4-hydroxyphenylsulfonyl)phenoxy}decaneamido), an alkylamino group (e.g., methylamino, butylamino, dodecylamino, diethylamino, methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{2-(3-t-butyl-4-hydroxyphenoxy)dodecaneamide}anilino, an ureido group (e.g., methylureido, phenylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio)), an arylthio group (e.g., phenylthio, 2-butoxy-5-t-octylphenylthio, 3-pentadecylphenylthio, 2-carboxyphenylthio, 4-tetradecanamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), and an alkoxycarbonyl group (e.g., methoxycarbonyl, butyloxycarbonyl, dodecyloxycarbonyl, octadecyloxycarbonyl).

X represents a hydrogen atom or a group which is capable of being released when the coupler reacts with the oxidation product of a color developing agent, and specific examples thereof include a halogen atom (e.g., fluorine, chlorine, bromine), an alkoxyl group (e.g., ethoxy, methoxycarbonylmethoxy, carboxypropyloxy, methanesulfonylethoxy), an aryloxy group (e.g., 4-carboxyphenoxy, 4-(4-hydroxyphenylsulfonyl)phenoxy), an acyloxy group (e.g., acetoxy, benzoyloxy), a sulfonyloxy group (e.g., methanesulfonyloxy, benzenesulfonyloxy), an acylamino group (e.g., heptafluorobutyrylamino), a sulfonamido group (e.g., methanesulfonamido), an alkoxycarbonyloxy group (e.g., ethoxycarbonyloxy), a carbamoyloxy group (e.g., diethylcarbamoyloxy, piperidinocarbonyloxy, morpholinocarbonyloxy), an alkylthio group (e.g., 2-carboxyethylthio), an arylthio group (e.g., 2-octyloxy-5-t-octylphenylthio, 2-(2,4-di-t-amylphenoxy)butyrylaminophenylthio), a heterocyclic thio group (e.g., 1-phenyltetrazolylthio, 2-benzimidazolylthio), a 5- or 6-membered nitrogen-containing heterocyclic group (e.g., 1-imidazolyl, 1-pyrazolyl, 1-benzotriazolyl, 2-phenylcarbamoyl-1-imidazolyl), an imido group (e.g., 5,5-dimethylhydantoin-3-yl, 1-benzylhydantoin-3-yl, 5,5-dimethyloxazolidine-2,4-dion-3-yl), an azo group (e.g., 4-methoxyphenylazo, 4-pivaloylaminophenylazo), and a bis-type coupler bonded to the coupling position via an alkylidene group. X may also be a released group having a timing function which further releases a development inhibitor or a development accelerator by electron transfer or intramolecular nucleophilic substitution after being released (elimination).

Preferred examples of X include a hydrogen atom, a chlorine atom, an aryloxy group (e.g., phenoxy, 4-carboxyphenoxy), a carbamoyloxy group (e.g., diethylcarbamoyloxy, morpholinocarbonyloxy), an arylthio group (e.g., 2-octyloxy-5-t-octylphenylthio), a heterocyclic thio group (e.g., phenyltetrazolylthio), a nitrogen-containing 5-membered heterocyclic group (e.g., imidazolyl, pyrazolyl), and an imido group (e.g., 5,5-dimethylhydantoin-3-yl, 1-benzyl-5-ethoxyhydantoin-3-yl).

The coupler represented by the above formula may form a dimer or more polymer through substituents of $R_1$, $R_2$ and $R_3$, or may be bonded to a polymer chain.

Specific examples of the couplers according to the present invention are shown below, but the present invention is not limited thereto.

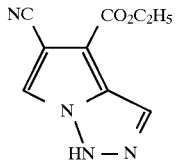

(1)

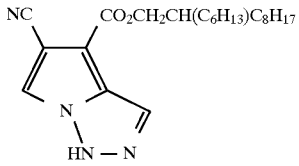

(2)

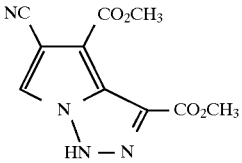

(3)

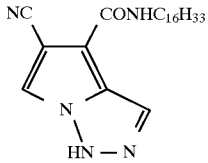

(4)

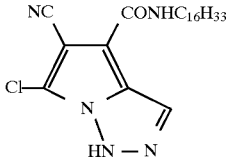

(5)

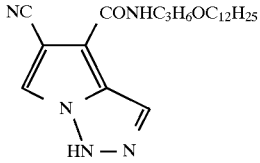

(6)

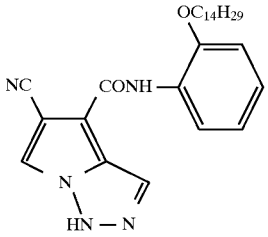

(7)

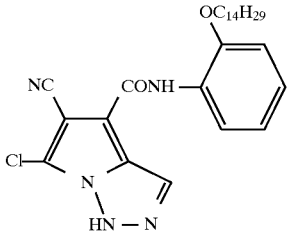

(8)

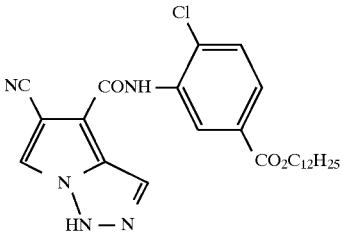

(9)

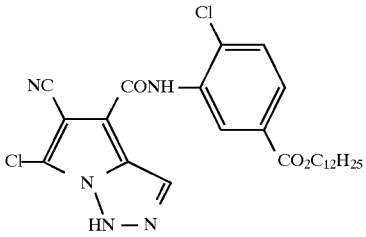

(10)

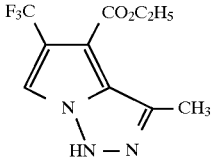

(11)

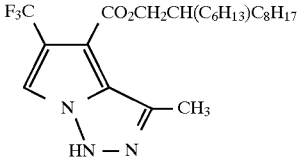

(12)

-continued
(13)
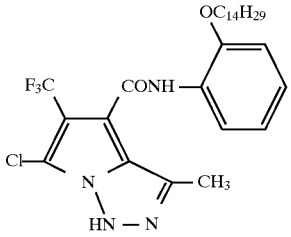
(14)
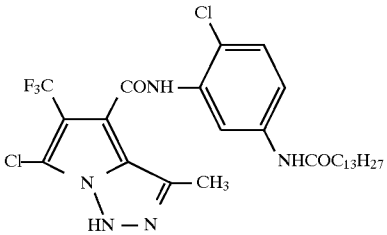
(15)
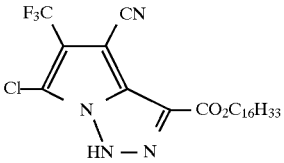
(16)
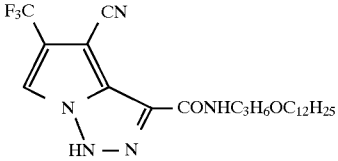
(17)
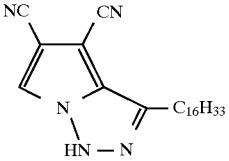
(18)
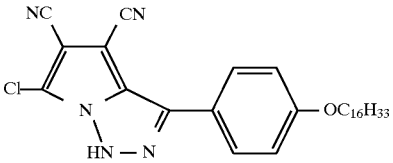
(19)
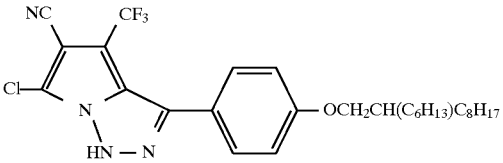
(20)
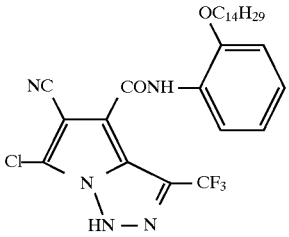
(21)
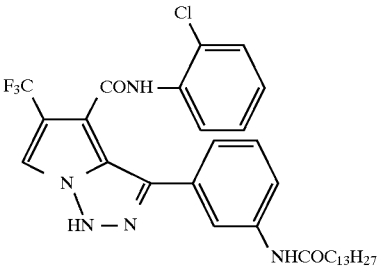
(22)
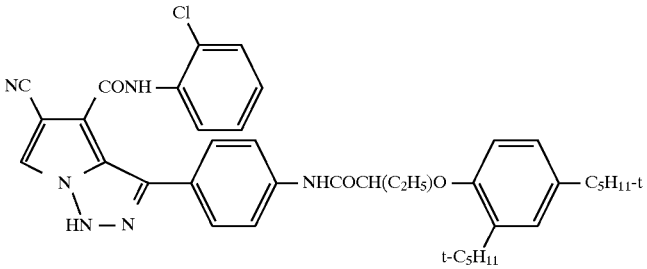
(23)
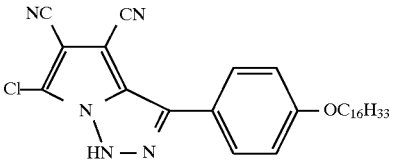
(24)
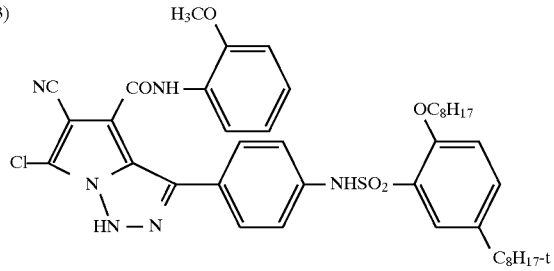

-continued
(25)
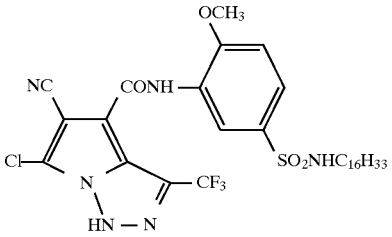
(26)
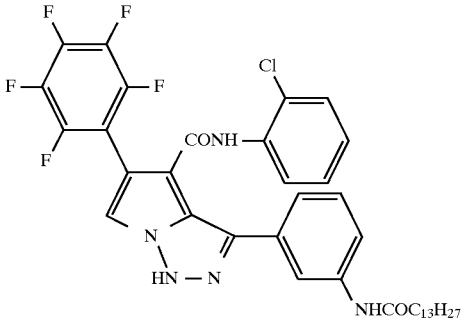
(27)
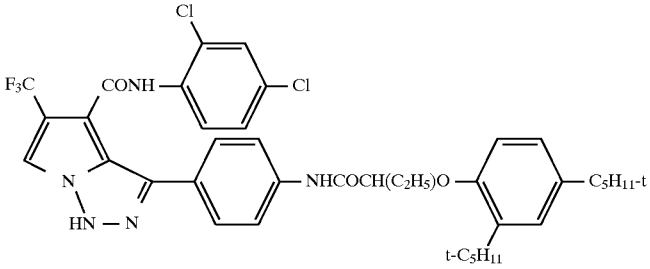
(28)
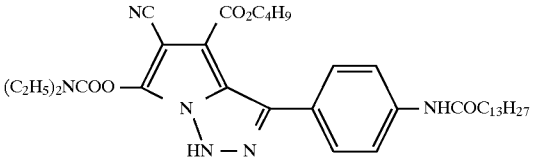
(29)
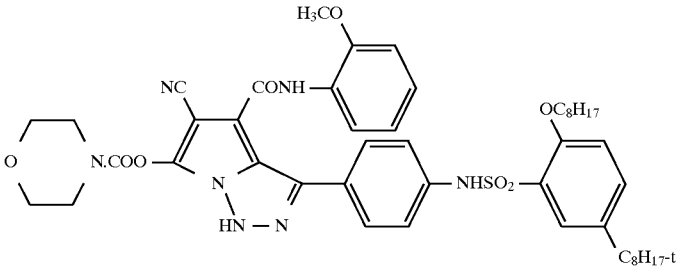
(30)
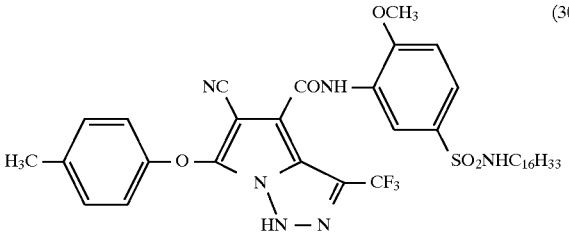
(31)
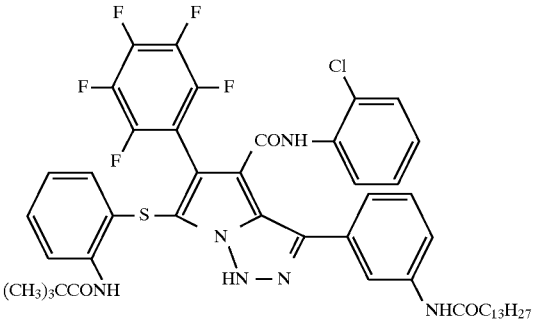
(32)
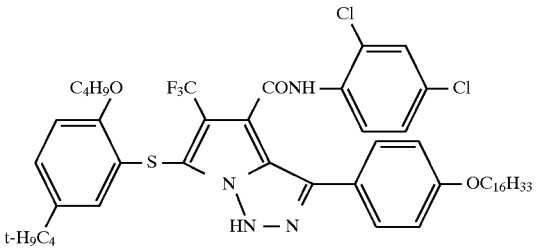
(33)
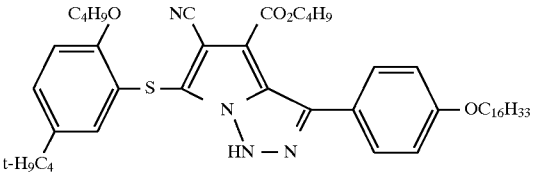

-continued
(34)
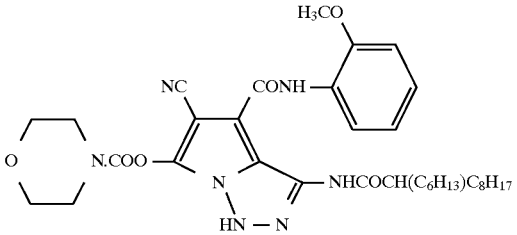
(35)
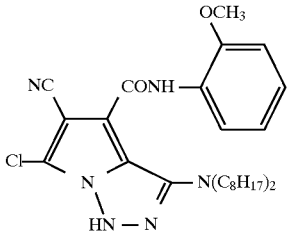
(36)
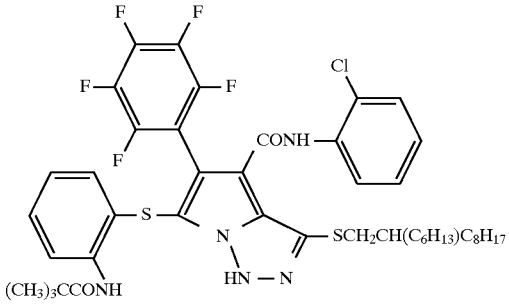
(37)
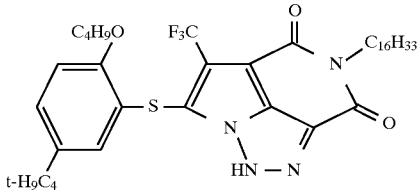
(38)
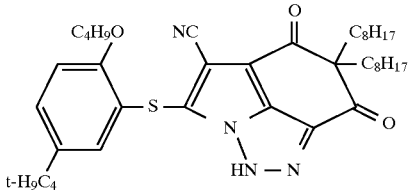
(39)
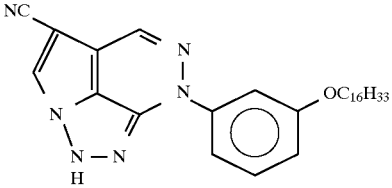
(40)
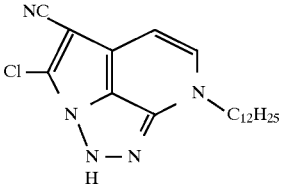
(41)
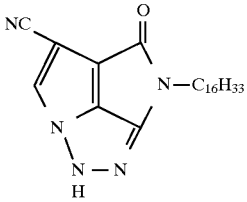
(42)
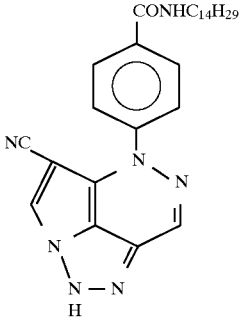
(43)
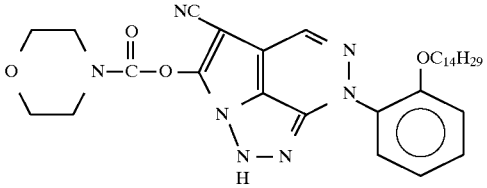
(44)
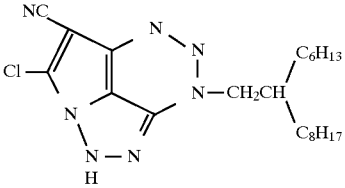
(45)
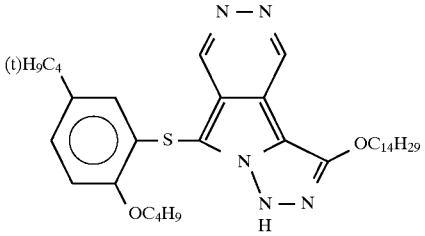

-continued (46)

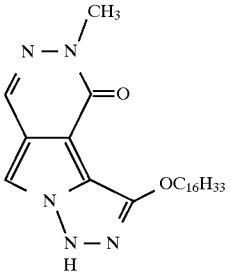

(47)

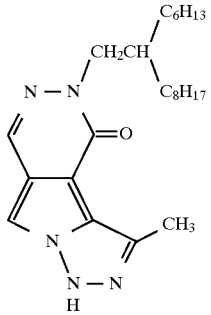

(48)

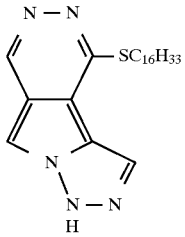

(49)

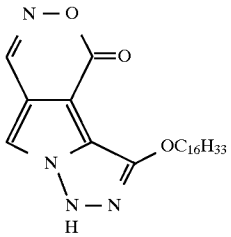

(50)

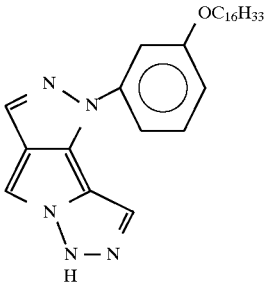

The compound of the present invention can be synthesized according to several methods, for example, by condensation or cyclization reaction of 4-substituted methyl-1,2,3-triazoles with 2,3-dihalopropionitriles or 2,3-dihalopropionates. Specific synthesis examples are shown below.

SYNTHESIS EXAMPLE 1

Synthesis of Coupler (1)

Three point zero eight (3.08) grams of ethyl 1,2,3-triazol-4-yl acetate was dissolved in 25 ml of tetrahydrofuran, then 4 ml of 2,6-lutidine was added thereto. Subsequently, a solution of 5 ml of methylene chloride containing 3.52 g of bromine having dissolved therein was dropwise added to the above mixture at room temperature. After stirring the solution for 30 minutes, the reaction solution was poured into water and extracted with ethyl acetate. The extract was washed with water, dried over magnesium sulfate anhydride, then ethyl acetate was distilled off under reduced pressure. Twenty (20) ml of dimethylacetamide was added to the residue to dissolve the residue, 5.11 g of 2,3-dibromopropionitrile was added thereto and, further, 1.8 ml of diisopropylethylamine was dropwise added at 0° C. After being stirred for 3 hours at room temperature, the reaction solution was poured into 100 ml of cold diluted hydrochloric acid and extracted with ethyl acetate. The extract was washed with water and dried, then ethyl acetate was distilled off under reduced pressure. The residue was subjected to purification through silica gel column chromatography to obtain 1.3 g of Coupler (1) as white crystal. Melting point: 152°–155° C.

SYNTHESIS EXAMPLE 2

Synthesis of Coupler (3)

Four point zero (4.0) grams of methyl 5-methoxycarbonyl-1,2,3-triazol-4-yl acetate synthesized according to the method disclosed in *J. Heterocycl. Chem.,* 17, 159 (1980) was dissolved in 20 ml of tetrahydrofuran, then 7.02 g of pyridinium hydrobromide perbromide was gradually added thereto at room temperature. After stirring the solution for 1 hour at room temperature, the reaction solution was poured into water and extracted with ethyl acetate. After the extract was washed with water, the solvent was distilled off under reduced pressure. Twenty (20) ml of dimethylacetamide was added to the residue to dissolve the residue, 5.11 g of 2,3-dibromopropionitrile was added thereto and, further, 2.1 ml of diisopropylethylamine was dropwise added at 0° C.

After being stirred for 4 hours at room temperature, 100 ml of 1N hydrochloric acid was added to the reaction solution and the solution was extracted with ethyl acetate.

The extract was washed with water and dried, then the solvent was distilled off under reduced pressure. The residue was subjected to purification through silica gel column chromatography to obtain 1.8 g of Coupler (3) as white crystal.

Other couplers can also be synthesized according to analogous methods.

It should be sufficient for the photographic material of the present invention to comprise a support having thereon at least one layer containing the coupler of the present invention, and the coupler is, in general, contained in a hydrophilic colloid layer comprising a gelatin binder. General photographic materials can comprise at least one blue-sensitive silver halide emulsion layer, at least one green-sensitive silver halide emulsion layer and at least one red-sensitive silver halide emulsion layer on a support, and the order of the arrangement of the layers are not specifically limited. Further, an infrared-sensitive silver halide emulsion layer can be provided in place of one layer of the above-described light-sensitive emulsion layers. Color reproduction can be effected according to the subtractive color process by incorporating into these light-sensitive emulsion layers couplers capable of forming dyes having a complementary color relationship to light to which the corresponding silver halide emulsion is sensitized. Further, a constitution of a different correspondence of a light-sensitive layer to a hue of developed color from those described above may be employed.

The coupler according to the present invention is useful as a yellow, magenta or cyan coupler and can be incorporated into any light-sensitive silver halide emulsion layer.

The addition amount of the coupler according to the present invention to a photographic material is properly from $1\times10^{-3}$ to 1 mol, preferably from $2\times10^{-3}$ to $3\times10^{-1}$ mol, per mol of the silver halide.

The coupler according to the present invention can be incorporated into a photographic material using various known dispersion methods, and an oil-in-water dispersion method is preferably used, which comprises dissolving the coupler in a high boiling point organic solvent (a low boiling point organic solvent may be used in combination, if necessary), dispersing the dissolved coupler into an aqueous gelatin solution in the form of an emulsion, and incorporating the dispersion into a silver halide emulsion.

Examples of high boiling point organic solvents which can be used in the oil-in-water dispersion method are disclosed, for example, in U.S. Pat. No. 2,322,027. Further, specific examples of the latex dispersion method, which is one of the polymer dispersion methods, are disclosed in U.S. Pat. No. 4,199,363, West German Patent Application (OLS) No. 2,541,274 and JP-B-53-41091 (the term "JP-B" as used herein means an "examined Japanese patent publication"), and the dispersion method using an organic solvent-soluble polymer is disclosed in WO 88/723.

Examples of high boiling point organic solvents which can be used in the oil-in-water dispersion method include phthalic acid esters (e.g., dibutyl phthalate, dioctyl phthalate, di-2-ethylhexyl phthalate), phosphoric acid or phosphonic acid esters (e.g., triphenyl phosphate, tricresyl phosphate, tri-2-ethylhexyl phosphate), fatty acid esters (e.g., di-2-ethylhexyl succinate, tributyl citrate), benzoic acid esters (e.g., 2-ethylhexyl benzoate, dodecyl benzoate), amides (e.g., N,N-diethyldodecanamide, N,N-dimethyloleinamide), alcohols or phenols (e.g., isostearyl alcohol, 2,4-di-tert-amylphenol), anilines (e.g., N,N-dibutyl-2-butoxy-5-tert-octylaniline), chlorinated paraffins, hydrocarbons (e.g., dodecylbenzene, diisopropylnaphthalene), carboxylic acids (e.g., 2-(2,4-di-tert-amylphenoxy) butyrate), etc. Further, organic solvents having a boiling point of from 30° C. to 160° C. (e.g., ethyl acetate, butyl acetate, methyl ethyl ketone, cyclohexanone, methyl cellosolve acetate, dimethylformamide) may be used in combination as an auxiliary solvent. A high boiling point organic solvent can be used in a range of from 0 to 10 times, preferably from 0 to 4 times, the amount of the coupler, in a weight ratio.

As silver halide emulsions applicable to the present invention, other materials, the layer structures of the photographic material, processing methods and additives which are applied for processing the photographic material, those disclosed in JP-A-62-215272 (the term "JP-A" as used herein means an "unexamined published Japanese patent application"), JP-A-2-33144, JP-A-2-854, JP-A-2-93641 and JP-A-3-194539 can be preferably used.

As the compound which forms a dye upon oxidation coupling with the coupler of the present invention, not only generally used aromatic primary amine compounds (e.g., phenylenediamine based color developing agents) but also the sulfonyl hydrazine compounds and the carbamoyl hydrazine compounds disclosed in EP-A-545491, EP-A-565165 and Japanese Patent Application No. 7-49287 can be used.

The coupler according to the present invention can preferably be used in a photographic material having a magnetic recording layer for an advanced photo system. Further, the coupler of the present invention can be applied to a system in which heat development is conducted using a little amount of water and a completely dry system in which heat development is conducted using absolutely no water. These systems are disclosed in detail in JP-A-6-35118, JP-A-6-17528, JP-A-56-146133, JP-A-60-119557 and JP-A-1-161236.

The present invention will be illustrated in more detail with reference to the following examples, but these are not to be construed as limiting the invention.

EXAMPLE 1

Preparation of Sample No. 101

Emulsified Dispersion (1) of Comparative Coupler (C-1) was prepared according to the method described below.

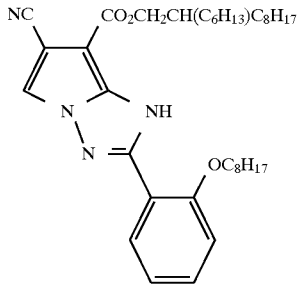

(C-1)

Zero point eight five (0.85) grams of Comparative Coupler (C-1) and 1.2 g of tricresyl phosphate were melted by heating in 10 ml of ethyl acetate (this was designated oil phase solution).

Differently from the above, 4.2 g of gelatin was added to 25 ml of water of room temperature, after the gelatin was completely swollen, the solution was heated to 40° C. and the gelatin was thoroughly dissolved. Three (3) ml of a 5% aqueous solution of sodium dodecylbenzenesulfonate and the above-prepared oil phase solution were added to the aqueous gelatin solution while maintaining the temperature at about 40° C., and emulsified dispersed with a homogenizer to prepare Emulsified Dispersion (1). A coating solution having the composition shown below was prepared using this Emulsified Dispersion (1), and the coating solution was coated on a polyethylene laminate paper (polyethylene contained 15 wt % of titanium oxide) having an undercoat layer in the amount of coupler of 1 mmol/$m^2$. Further, 2 g/$m^2$ of gelatin was coated thereon as a protective layer to prepare Sample No. 101.

| Coating Solution | |
|---|---|
| Emulsion: Silver Chlorobromide (Br: 1 mol %) | 13 g |
| 10% Gelatin | 28 g |
| Emulsified Dispersion (1) | 22 g |
| Water | 37 ml |
| A 4% Aqueous Solution of Sodium 1-Hydroxy-3,5-dichloro-s-triazine | 5 ml |

Preparation of Sample Nos. 102 to 111

Sample Nos. 102 to 111 were prepared in the same manner as the preparation of Sample No. 101, except that the coupler of the present invention shown in Table 1 was added each in an equimolar amount in place of Comparative Coupler (C-1).

Each of the above-prepared samples was wedgewise exposed to white light and color development processing was conducted according to the processing step shown below.

Subsequently, each of these samples was subjected to a forced discoloration test by irradiation using a xenon discoloration tester (100,000 lux) for six days. The residual density after testing at density 1.0 before testing was measured and this was made criterion of image stability. The results obtained are shown in Table 1.

TABLE 1

| Sample No. | Coupler | Residual Rate of Dye (%) | Remarks |
|---|---|---|---|
| 101 | (C-1) | 51 | Comparison |
| 102 | (2) | 82 | Invention |
| 103 | (4) | 86 | Invention |
| 104 | (6) | 81 | Invention |
| 105 | (7) | 83 | Invention |
| 106 | (9) | 82 | Invention |
| 107 | (12) | 83 | Invention |
| 108 | (13) | 88 | Invention |
| 109 | (16) | 85 | Invention |
| 110 | (20) | 84 | Invention |
| 111 | (24) | 82 | Invention |

Processing Step

| Processing Step | Processing Temperature (°C.) | Processing Time (sec) |
|---|---|---|
| Color Development | 35 | 45 |
| Bleach Fixing | 30–35 | 45 |
| Stabilization (1) | 30–35 | 20 |
| Stabilization (2) | 30–35 | 20 |
| Stabilization (3) | 30–35 | 20 |
| Drying | 70–80 | 60 |

The composition of each processing solution used was as follows.

| Color Developing Solution | |
|---|---|
| Water | 700 ml |
| Ethylenediaminetetraacetic Acid | 3.0 g |
| Triethanolamine | 12.0 g |
| Sodium Chloride | 6.5 g |
| Potassium Bromide | 0.03 g |
| Potassium Carbonate | 27 g |
| N-Ethyl-N-(β-methanesulfonamidoethyl)-3-methyl-4-aminoaniline Sulfate | 5.0 g |
| Disodium-N,N-bis(sulfonatoethyl)-hydroxylamine | 10.0 g |
| Disodium 1,2-dihydroxybenzene-4,6-disulfonate | 0.5 g |
| Sodium Triisopropylene(β)-sulfonate | 0.1 g |
| Sodium Sulfite | 0.1 g |
| Brightening Agent (WHITEX 4, manufactured by Sumitomo Chemical Co., Ltd.) | 1.0 g |
| Water to make | 1,000 ml |
| pH (25° C.) | 10.0 |
| **Bleach-Fixing Solution** | |
| Water | 600 ml |
| Aqueous Solution of Ammonium Thiosulfate (700 g/liter) | 100 ml |
| Ammonium Sulfite | 40 g |
| Ammonium Ethylenediaminetetraacetato Ferrate | 55 g |
| Disodium Ethylenediaminetetraacetate | 5 g |
| Ammonium Bromide | 40 g |
| Nitric Acid (67%) | 30 g |
| Water to make | 1,000 ml |
| pH (25° C). | 5.8 |

Stabilizing Solution

Ion Exchange Water (each concentration of calcium and magnesium was 3 ppm or less)

As is apparent from Table 1, the couplers according to the present invention are excellent in light fastness.

EXAMPLE 2

Into the mixture comprising 0.78 g of Comparative Coupler (C-2), 0.80 g of N-ethyl-N-(β-methanesulfonamidoethyl)-3-methyl-4-aminoaniline sulfate, 3.75 g of sodium carbonate, 60 ml of chloroform and 50 ml of water, a solution of 10 ml of water having dissolved therein 1.65 g of ammonium persulfate was gradually added with stirring at room temperature. After stirring the reaction solution for one hour, a chloroform layer was separated and the reaction solution was subjected to purification through silica gel column chromatography to obtain Azomethine Dye (CD-2). Further, Azomethine Dyes (D-1) to (D-4) were synthesized using the couplers of the present invention in place of Coupler (C-2).

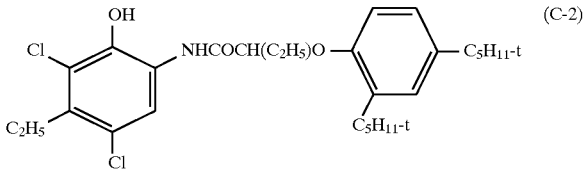

(C-2)

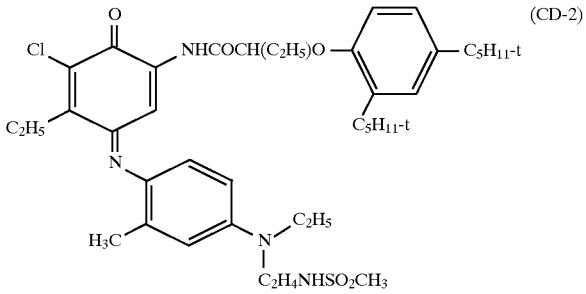

(CD-2)

-continued (D-1)

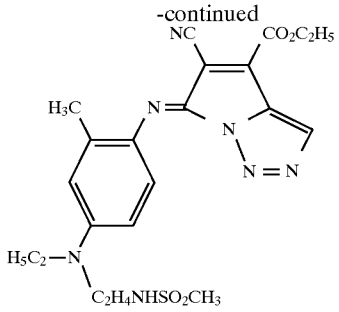

(D-2)

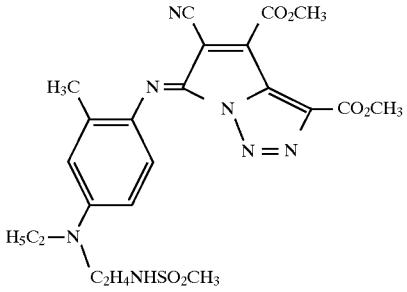

(D-3)

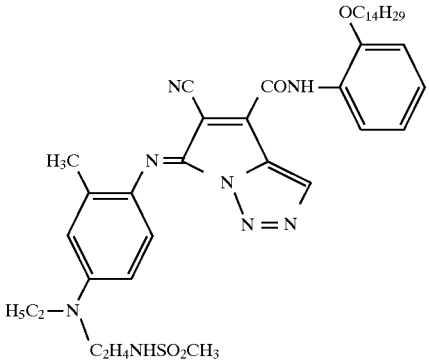

(D-4)

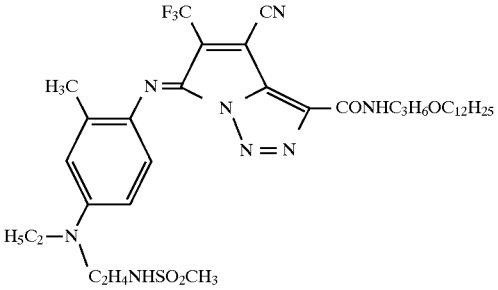

One point five (1.5) mg of Azomethine Dye (CD-2) was accurately weighed and put in a 100 ml measuring flask and dissolved by adding ethyl acetate, then diluted to 100 ml and Sample Solution 201 was obtained.

This sample solution was put in a quartz cell having a thickness of 1 cm and visible absorption spectrum was measured using a spectrophotometer for ultraviolet and visible region (manufactured by Shimadzu Seisakusho).

Ethyl Acetate Solutions 202 to 205 of Azomethine Dyes (D-1) to (D-4) were prepared in the same manner and each absorption spectrum was measured. Subsequently, in absorption properties of dyes, as the criterion showing the degree of side absorption in a shorter wavelength side, absorption strength b/a in strength of side absorption/λmax was evaluated. The smaller the b/a, the more preferred is the absorption properties from the viewpoint of color reproduction. The results obtained are shown in Table 2 below.

TABLE 2

| Sample No. | Dye | b/a | Remarks |
|---|---|---|---|
| 201 | (CD-2) | 0.28 | Comparison |
| 202 | (D-1) | 0.04 | Invention |
| 203 | (D-2) | 0.07 | Invention |
| 204 | (D-3) | 0.05 | Invention |
| 205 | (D-4) | 0.03 | Invention |

It can be understood from the results in Table 2 that the dyes formed from the couplers of the present invention have small side absorption and are excellent in spectral absorption properties.

The dyes formed from the couplers of the present invention are excellent in spectral absorption properties and color reproduction. In addition, the color images obtained from the couplers of the present invention are superior in light fastness.

While the invention has been described in detail and with reference to specific examples thereof, it will be apparent to one skilled in the art that various changes and modifications can be made therein without departing from the spirit and scope thereof.

What is claimed is:

1. A silver halide color photographic material containing at least one 1H-pyrrolo[1,2-c][1,2,3]triazole dye-forming coupler represented by the following formula:

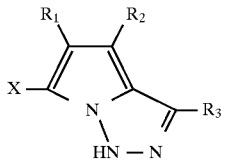

wherein $R_1$, $R_2$ and $R_3$ each represents a hydrogen atom or a substituent; and X represents a hydrogen atom or a group capable of being released upon reaction with the oxidation product of a color developing agent, and $R_1$ and $R_2$, or $R_2$ and $R_3$ may be connected to each other to form a 5- or 6-membered ring.

2. The silver halide color photographic material as claimed in claim 1, wherein $R_1$ represents an electron withdrawing group having a Hammett's $\sigma_p$ value of 0.3 or more.

3. The silver halide color photographic material as claimed in claim 1, wherein $R_1$ and $R_2$ each represents an electron withdrawing group having a Hammett's $\sigma_p$ value of 0.3 or more.

* * * * *